US006688060B2

(12) United States Patent
Sawada

(10) Patent No.: US 6,688,060 B2
(45) Date of Patent: Feb. 10, 2004

(54) JOINER FOR VERTICAL JOINT FOR EXTERNAL WALL MEMBERS

(75) Inventor: Koji Sawada, Aichi (JP)

(73) Assignee: Nichiha Corporation, Nagoya (JP)

( * ) Notice: Subject to any disclaimer, the term of this patent is extended or adjusted under 35 U.S.C. 154(b) by 89 days.

(21) Appl. No.: 09/952,800

(22) Filed: Sep. 14, 2001

(65) Prior Publication Data

US 2002/0056243 A1 May 16, 2002

(30) Foreign Application Priority Data

Sep. 14, 2000 (JP) ..... 2000-280475

(51) Int. Cl.[7] ..... E04C 1/00

(52) U.S. Cl. ..... 52/309.13; 52/177; 403/265; 403/266; 403/268

(58) Field of Search ..... 52/177, 586.1, 52/586.2, 731.7, 309.13, 396.04, 717.05; 403/26, 42, 404, 52, 64, 66, 70, 71, 72, 179, 265–266, 403, 408.1, 354, 363, 382

(56) References Cited

U.S. PATENT DOCUMENTS

| | | | | |
|---|---|---|---|---|
| 2,065,920 A | * | 12/1936 | Clark | 52/275 |
| 4,837,997 A | * | 6/1989 | Zeilinger | 52/280 |
| 5,346,957 A | * | 9/1994 | Tsuji et al. | 525/122 |
| 5,363,612 A | * | 11/1994 | Erickson | 52/239 |
| 6,092,349 A | * | 7/2000 | Trenerry | 52/730.6 |
| 6,202,377 B1 | * | 3/2001 | Krieger | 52/489.1 |
| 6,360,510 B1 | * | 3/2002 | Woodrum et al. | 52/731.1 |
| 6,427,408 B1 | * | 8/2002 | Krieger | 52/489.1 |

FOREIGN PATENT DOCUMENTS

| | | | |
|---|---|---|---|
| JP | 62-22248 | | 2/1987 |
| JP | 4-134306 | | 12/1992 |
| JP | 3004443 | | 11/1994 |
| JP | 7-54414 | * | 2/1995 |
| JP | 7-180318 | | 7/1995 |
| JP | 8-74338 | * | 3/1996 |
| JP | 3030088 | | 10/1996 |
| JP | 9-4079 | | 1/1997 |
| JP | 11-36553 | | 2/1999 |
| JP | 11-256110 | * | 9/1999 |
| JP | 3084190 | | 9/2000 |

OTHER PUBLICATIONS

Office Action issued in corresponding Japanese Application No. 2000–280475 dated Oct. 23, 2002 (including an English translation).

* cited by examiner

*Primary Examiner*—Jeanette Chapman
(74) *Attorney, Agent, or Firm*—Shook, Hardy & Bacon, LLP

(57) ABSTRACT

A joiner for vertical joint which is adapted to be placed at a vertical joint formed between end faces of a couple of neighboring external wall members. This joiner is designed such that the adhesive force between the sealing material and the surface region of raised portion of the joiner is minimized, thereby making it possible to prevent the sealing material from being cracked or peeled away. This joiner is featured in that the surface region of said raised portion is constituted by a resin layer formed of a resin selected from the group consisting of polyethylene, polypropylene and fluororesin, and having an embossed surface.

7 Claims, 8 Drawing Sheets

JOINER FOR VERTICAL JOINT FOR EXTERNAL WALL MEMBERS

BACKGROUND OF THE INVENTION

1. Field of the Invention

This invention relates to a joiner for vertical joint which is designed to be placed at a vertical joint formed between end faces (or side faces) of neighboring external wall members such as siding boards.

2. Description of the Related Arts

It is known to construct the external wall of building by attaching external wall members such as ceramic siding boards to the framework of building in such a manner that the end portions (or end faces) of external wall members are butted against one another. FIG. 6 illustrates one example of such an external wall structure, wherein the coupling of external wall members 10 are joined together in such a manner that the end faces of external wall members 10 are butted against one another by making use of a couple of fastening members 12 secured to a vertical furring strip 11. In this case, by taking the expansion and shrinkage of the external wall members 10 due to temperature or the dimensional shrinkage with time into consideration, a couple of neighboring wall members are usually fixed to the furring strip 11 in such a manner that a gap (vertical joint portion) 13 of about 10 mm is provided between the facing ends of these neighboring wall members. An elongated vertical joiner 20 is used to keep space between the facing ends.

The elongated vertical joiner 20 for vertical joint provided with a raised portion 21 is attached to the vertical furring strip 11 in such a manner that the raised portion 21 can be fitted into the gap or vertical joint portion 13. By the way, the vertical joiner 20 shown in FIG. 6 is of a type called a hat joiner and usually made of resin or metal. The worked structure of the vertical joint portion where the aforementioned vertical joiner 20 is employed is also applied to the joining gap portions on both sides of the external corner formative member 30 as shown in FIG. 7 (by the way, in FIG. 7, the same reference numbers as those of FIG. 6 are employed for the constituent members having the same functions as those of FIG. 6).

A sealing compound 14 made of an elastic material is filled in the gap 13 in order to prevent rain water from penetrating inward through this gap 13. The raised portion 21 of the elongated vertical joiner 20 functions as a receiving area for the sealing compound 14. As for specific examples of the sealing compound 14, modified silicone, polysulfide, polyurethane, acrylic and butyl rubber are frequently employed due to their characteristics of elastic deformation, enabling them to elastically deform, to absorb or to follow any changes in the gap (width of joint) resulting from the shrinkage or expansion of the siding boards after the installation thereof, thereby preventing the fracturing of the hermetically sealed state of the gap that may be caused due to the cracking or peeling of the sealing compound 14.

By the way, if the sealing material for sealing the vertical joint portion is filled in the vertical joint portion under such a condition that only a couple of end faces of siding boards disposed on the opposite sides of the sealing material (bonding interfaces) are kept in a bonded state with the other aides of the sealing material being kept in a non-adhered state (kept free), the sealing material is enabled to exhibit an excellent follow-up property relative to the shrinkage and expansion of the siding boards. However, as shown in FIG. 8 illustrating the top view of the worked structure of the vertical joint portion, according to the worked structure of the vertical joint portion where the aforementioned vertical joiner 20 is employed, the surface region of raised portion 21 of the vertical joiner 20 (bottom face of the joint) becomes a third bonding Interface in addition to the aforementioned couple of end faces of siding boards disposed on the opposite sides of the sealing material. As a result, the elastic deformation of the sealing material is restricted by this third bonding interface, thereby obstructing the follow-up property of the sealing material and hence possibly leading to problems such as the cracking or peeling of the sealing member as the siding boards are shrunk or expanded. If the cracking or peeling of the sealing member is generated, the hermetical property of the sealing member in destroyed. Therefore, the cracking or peeling of the sealing member should be prevented at all costs.

In view of overcoming this problem, there has been proposed to adhere a tape called a bond breaker which is poor in adhesivity to the sealing material onto the surface region of the raised portion 21 of the vertical joiner 21. As for the specific examples of this bond breaker, there have been proposed various kinds of materials such as a water-repellent tape made of paper or cloth having a water-repellent treatment surface (Japanese Utility Model Unexamined Publication S62-22248), a release paper (Japanese Utility Model unexamined Publication H4-134306), a resin tape which is surface-treated so as to minimize the surface roughness and to make the surface thereof lustrous and smooth (Japanese Patent Unexamined Publication H11-36553), etc.

However, the conventional bond breakers are all defective in that the releasability thereof to the sealing material is not necessarily sufficient, so that they are still incapable of completely avoiding the formation of aforementioned third bonding interface between the surface region of raised portion of the joiner for vertical joint and the sealing material. As a result, there are occasionally occurred situations where the cracking or peeling is generated in the sealing material that has been filled in the vertical joint.

SUMMARY OF THE INVENTION

This invention has been accomplished under the circumstances as mentioned above, and therefore, an object of the present invention is to provide a joiner for vertical joint, which is very low in adhesiveness to a sealing material to be employed on the occasion of fixing the ordinary external building boards or siding boards, thereby making it possible to almost completely prevent the sealing material filled in the vertical joint from being subsequently cracked or peeled.

With a view to realize the aforementioned object, the prevent inventor has made a large number of experiments on the adhesiveness or releasability between various kinds of the sealing materials and various kinds of material to be employed as a joiner for vertical joint or as a bond breaker. The results of these experiments are shown in Table 1.

Namely, Table 1 shows the results wherein the feeling of releasability of the sealing materials from the joiners is evaluated at the moment when the sealing material is picked up and pulled by one's fingers. In this test, each of the sealing materials of various manufactures was cured for three days after it was applied to each of the bond breakers of various manufacturers, which was adhered in advance onto the top surface (bottom face of the joint) of hat joiner disposed at the interconnecting gap between the neighboring right and left siding boards. In Table 1, a sample wherein the sealing material was enabled to be completely peeled away from the joiner is indicated by a mark O; a sample wherein the sealing material was enabled to be partially peeled away from the joiner is indicated by a mark Δ; and a sample wherein the sealing material was completely adhered onto the joiner is indicated by a mark x. The symbols A, B, C, D, E, F, G, H, a, b, c, d and e shown in Table 1 represent manufacturers of the bond breakers or sealing materials.

TABLE 1

| | | Kinds of sealing materials | | | | | |
|---|---|---|---|---|---|---|---|
| | | Modified silicone | | | | PU | PS |
| Kinds of bond breaker | | a | b | c | d | a | e |
| A: | PE tape | x | ○ | ○ | x | x | ○ |
| B: | PE tape | Δ–x | x | x | x | ○ | x |
| C: | PE tape | x | x | Δ | ○ | x | ○ |
| C: | PP tape | x | x | x | x | x | x |
| D: | Silicone-treated PE tape | x | x | Δ | x | ○ | ○ |
| E: | TF tape | ○ | ○ | ○ | Δ–x | ○ | ○ |
| F: | Embossed PE tape with 5% recess | Δ | Δ | x | ○ | Δ | ○ |
| F: | Embossed PE tape with 15% recess | ○ | ○ | ○ | ○–Δ | ○–Δ | ○ |
| F: | Embossed PE tape with 30% recess | ○ | ○ | ○ | ○ | ○ | ○ |
| F: | Embossed PE tape with 70% recess | ○ | ○ | ○ | ○ | ○ | ○ |
| F: | Embossed PE tape with 90% recess | ○ | ○–Δ | ○ | ○–Δ | ○ | ○ |
| F: | Embossed PE tape with 95% recess | ○ | ○ | Δ | x | Δ | ○ |
| G: | Embossed PP tape with 80% recess | ○ | ○ | ○ | ○ | ○ | ○ |
| H: | Embossed TF tape with 20% recess | ○ | ○ | ○ | ○ | ○ | ○ |

PE: Polyethylene
PP: Polypropylene
TF: Teflon
PU: Polyurethane
PS: Polysulfide

The present invention is based on the findings obtained from the above experiments, and the joiner for vertical joint according to the present invention is featured in that it is adapted to be placed at a vertical joint formed between end faces of a couple of neighboring external wall members, wherein said joiner has a raised portion having almost the same width as that of vertical joint, and at least the top surface region of said raised portion is constituted by a resin layer formed of a resin selected from the group consisting of polyethylene, polypropylene and fluororesin, and having an embossed surface.

In a preferable embodiment of the present invention, the ratio of recessed portions on the embossed surface of the resin layer should be in the range of 10 to 90% per square centimeter, more preferably in the range of 20 to 80% per square centimeter. It has been found as a result of experiments conducted by the present inventor that if the ratio of recessed portions was less than 10% per square centimeter or higher than 90% per square centimeter, the releasability of the sealing material became slightly poor. Whereas when the ratio of recessed portions was confined within the range of 20 to 80% per square centimeter, the affect of embossed surface to improve the releasability of the sealing material was prominently admitted.

By the way, the terms "embossed surface" in the present invention is generally referred to a state wherein recessed portions are formed on a substantially flat surface irrespective of the configuration of the recessed portions. Namely, the configuration of the recessed portions may be optionally selected, e.g. dot-like, stripe-like, etc.

The joiner for vertical joint according to the present invention can be manufactured as follows. Namely, the main body portion and the resin layer portion having the aforementioned embossed surface are separately manufactured at first, and then, the resin layer portion is laminated on the surface region of raised portion of the main body portion of vertical joiner, thereby accomplishing the joiner. Alternatively, the joiner for vertical joint may be entirely molded out of polyethylene resin, polypropylene resin or fluororesin, thus forming it as an integral molded product.

In the case of the former manufacturing method, the raw material for the main body portion may be optionally selected, i.e. any kind of metallic materials or plastic materials can be employed. As for the resin layer portion having an embossed surface, it should be prepared in advance as an adhesive tape, thereby enabling the adhesive tape to be adhered, as required, onto the surface region of raised portion of the main body portion of vertical joiner. According to this former method, the manufacture of the joiner for vertical joint of the present invention cam be extremely facilitated.

The latter manufacturing method is preferable in the respect that since the joiner can be entirely molded by means of extrusion molding method, it becomes possible to obtain a molded product exhibiting an excellent releasability due to the higher density of resin. By the way, in this case, an embossing work is applied by any suitable means to the surface of raised portion of resin joiner after the extrusion molding thereof.

In either manufacturing methods, the cross-sectional configuration of the joiner for vertical joint according to the present invention can be optionally selected as long as it is provided at least with a raised portion which is capable of fitted into a vertical joint to be formed between neighboring external wall members such as siding boards.

According to the joiner for vertical joint of the present invention, since the adhesive force between the sealing material and the surface region of raised portion of the joiner can be extremely minimized, and hence the releasability of the sealing material can be extremely enhanced, there is little possibility that such a third adhesive surface that may restrict the elastic deformation of the sealing material fitted in the joint is formed between the sealing material and the surface region of raised portion of the joiner. As a result, it is now possible to almost completely prevent the sealing material filled in the vertical joint from being subsequently cracked or peeled away.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
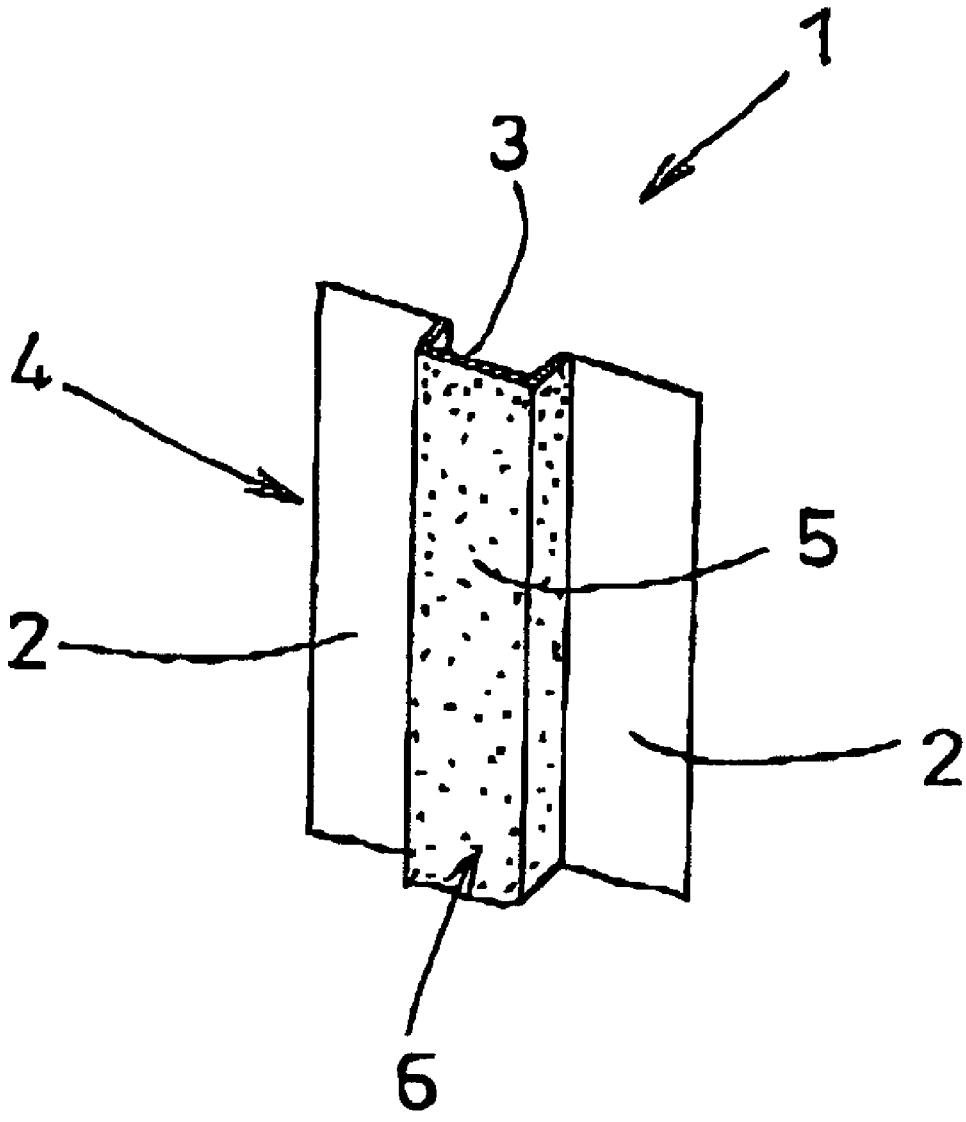
FIG. 1 is a perspective view illustrating one embodiment of the joiner for vertical joint according to this invention.
Figure 6:
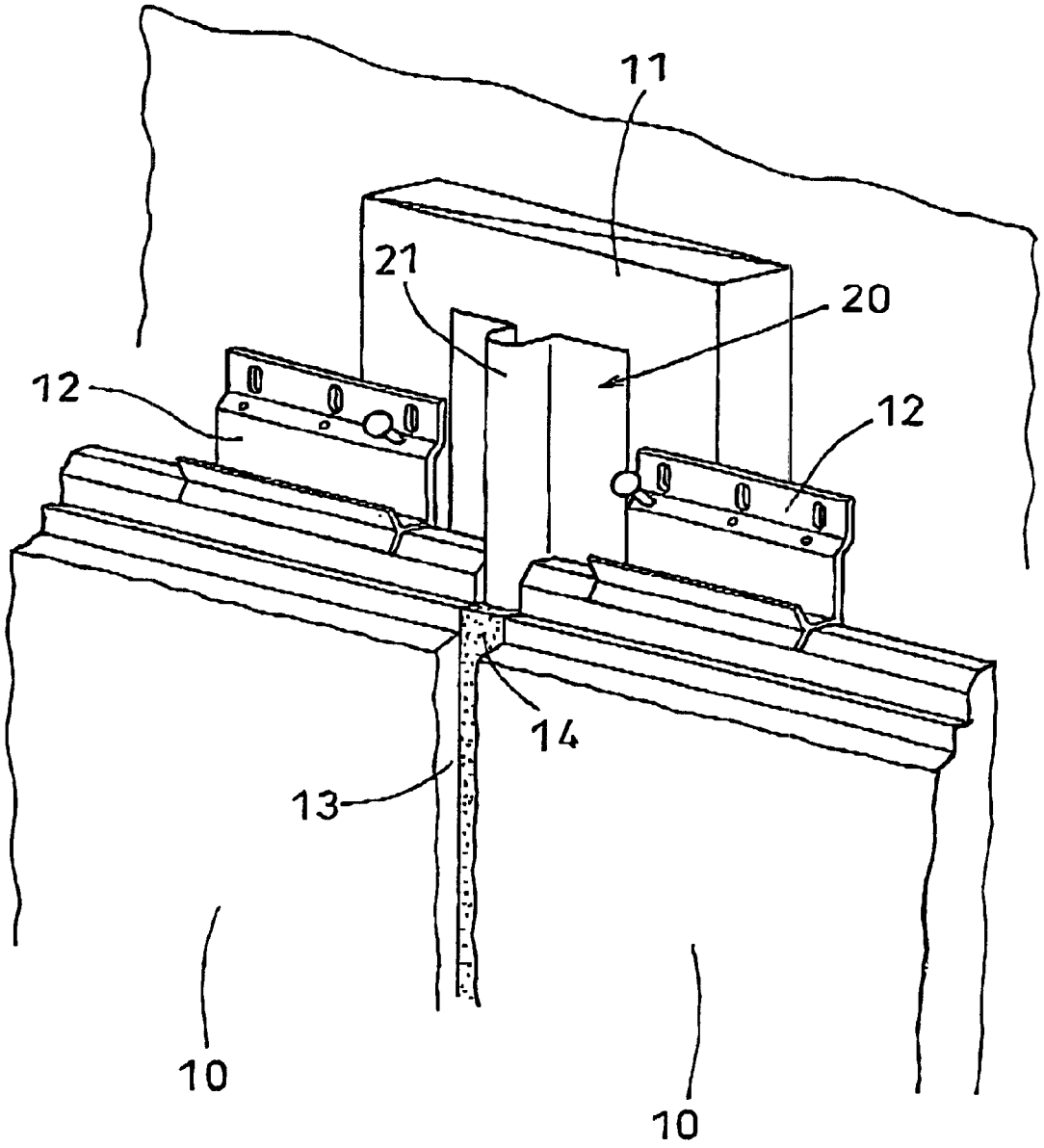
FIG.6 PRIOR ART
FIG. 6 is a perspective view illustrating a state of vertical joint to be formed on the occasion of fixing external wall members to the framework of building in a butt-joining manner.
Figure 7:
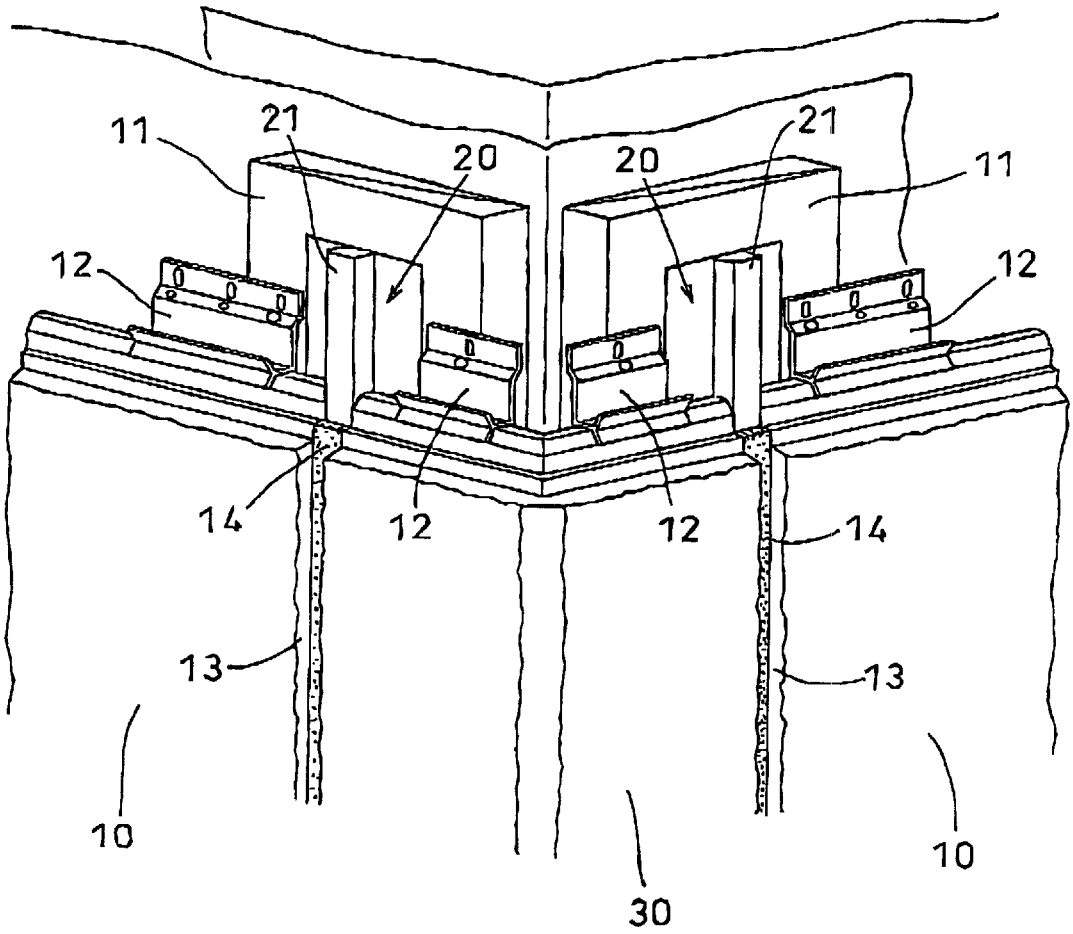
FIG.7 PRIOR ART
FIG. 7 is a perspective view illustrating a state of vertical joint to be formed on the occasion of fixing external wall members on both sides of external corner formative member in a butt-joining maser.
Figure 8:
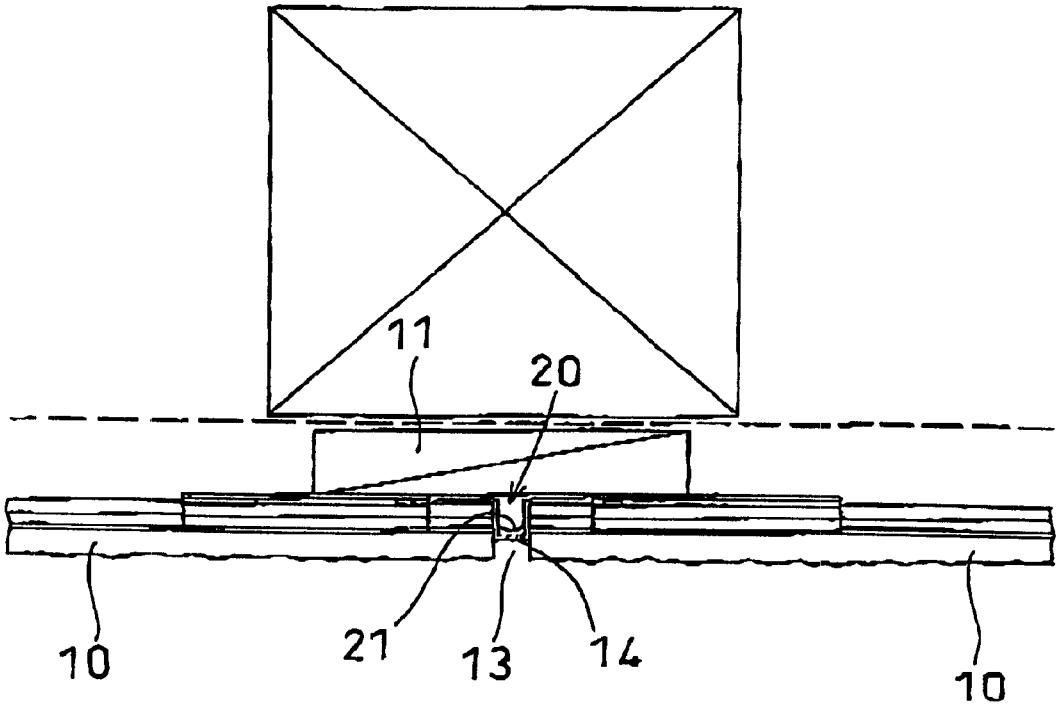
FIG.8 PRIOR ART
FIG. 8 is a top plan view illustrating a state of the vertical joint portion shown in FIG. 6.

Preferable embodiments of the present invention will be explained in details below with reference to the drawings FIG. 1 is a perspective view illustrating one embodiment of the joiner 1 for vertical joint according to this invention, which is formed into a so-called hat joiner. This joiner 1 is formed of a steel plate workpiece, which is constituted by a main body portion 4 comprising right and left base portions 2 both functioning as a securing surface to a framework of building, and a raised portion 3 which is designed to be fitted into a gap to be formed between neighboring external wall members, and by a resin tape 6 which is adhered to the surface region of the raised portion 3 (in the case shown in FIG. 1, the entire region including the front surface and both sidewalls of the raised portion 3) and made of a resin selected from the group consisting of polyethylene, polypropylene and fluororesin. Additionally, an embossing 5 is formed on the surface of the resin tape 6. Although not clearly shown in FIG. 1, the embossing 5 is constituted by a large number of recessed portions produced through an embossing work. In this embodiment, the ratio of the total area of the recessed portions is 70% per square centimeter. By the way, the manner of employing the joiner for vertical joint according to the present invention may be the same as those illustrated with reference to FIGS. 6 and 7, and hence the explanation about the manner of employment will be omitted herein.

Figure 2:
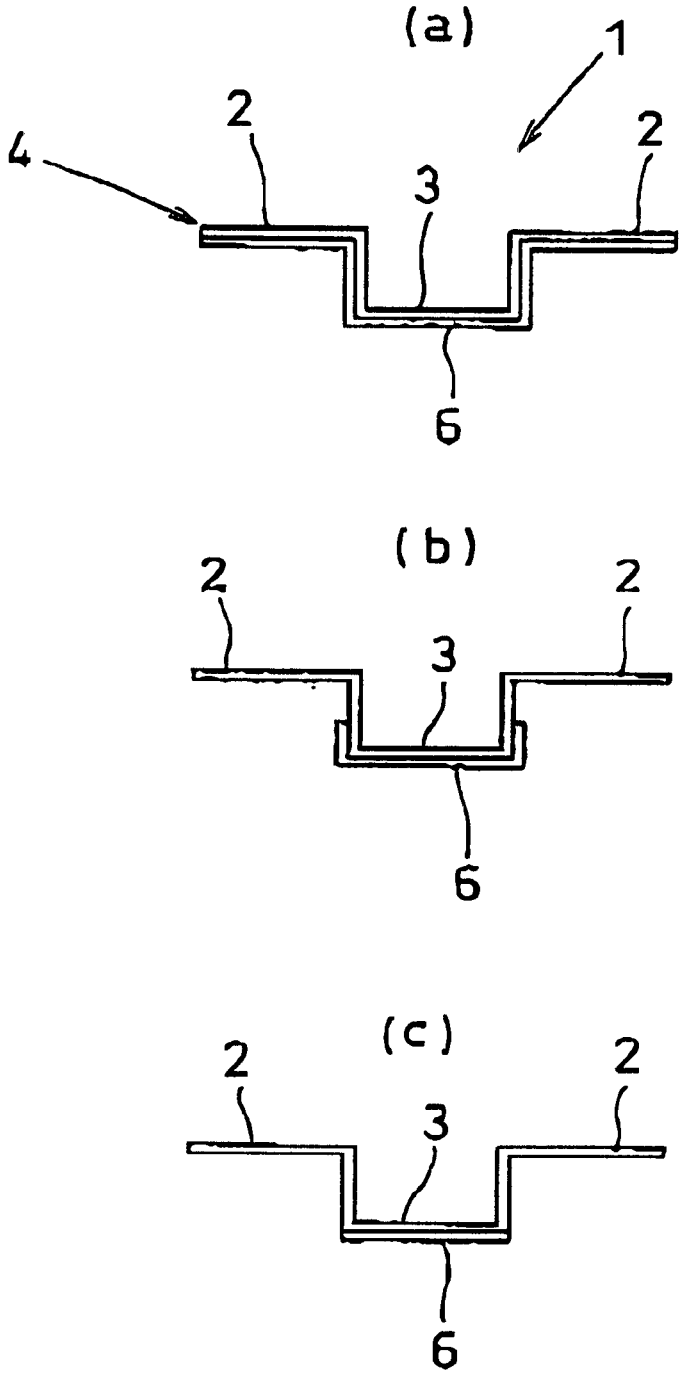
FIG. 2 shows top plan views illustrating various adhesion states of a resin tape onto the main body portion of the joiner for vertical joint.

The adhesion region of the resin tape 6 to the main body portion 4 is not limited to that shown in FIG. 1. Namely, the resin tape 6 may be adhered to the entire surface region of the main body portion 4 including the right and left base portions 2 as shown in FIG. 2*a*. Alternatively, the resin tape 6 may be adhered to the front surface of the raised portion 3 and part of the right and left sidewalls of the raised portion 3 as shown in FIG. 2*b*, or the resin tape 6 may be adhered to only the front surface of the raised portion 3 as shown in FIG. 2*c*. Thus, the magnitude of adhesion region of the resin tape 6 to the main body portion 4 may be suitably selected taking the working environment or the cost into consideration.

FIGS. 3*a* through 3*g* are top plan views illustrating various embodiments of the joiner 1 for vertical joint according to the present invention, wherein the aforementioned resin tape 6 is adhered by means of an adhesive to the surface region of the raised portion 3 which is designed to be fitted into the gap formed between the neighboring couple of external wall members such as siding boards. Specifically, the embodiment shown in FIG. 3*a* corresponds to the joiner 1 shown in FIG. 1. Whereas, in the embodiment shown in FIG. 3*b*, the base portion 2 is provided only on one side of raised portion 3; in the embodiment shown in FIG. 3*b'*, one of the sidewalls of raised portion 3 is inclined inward; in the embodiments shown in FIGS. 3*c* and 3*d*, the cross-section of raised portion 3 is semi-circular or semi-elliptical and the resin tape 6 is adhered to the entire surface of the raised portion 3. In the embodiment shown in FIG. 3*d*, the base portion 2 is provided only on one side of raised portion 3.

Figure 3:
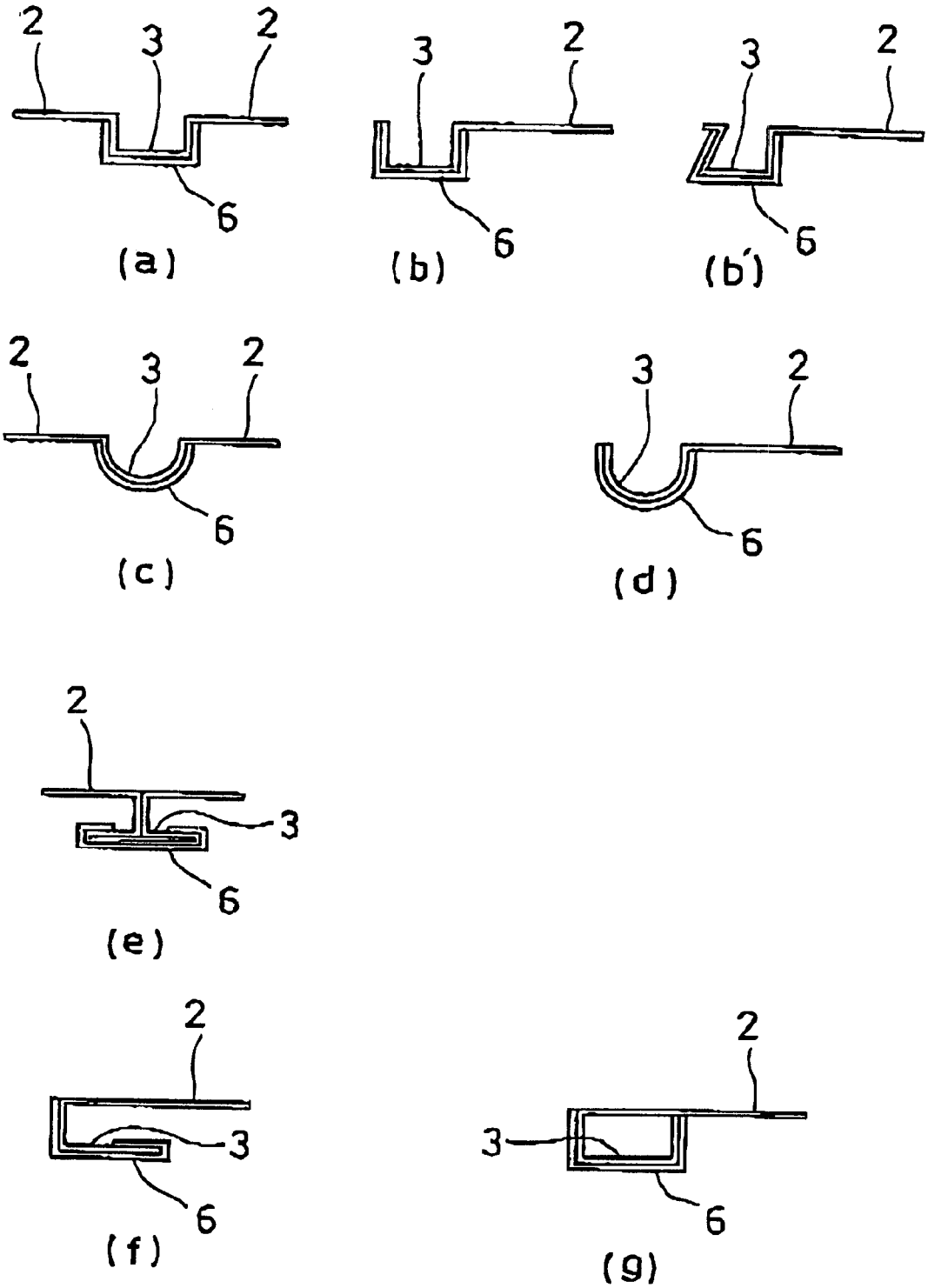
FIG. 3 shows top plan views illustrating various embodiments of joiner for vertical joint according to this invention.
Figure 4:
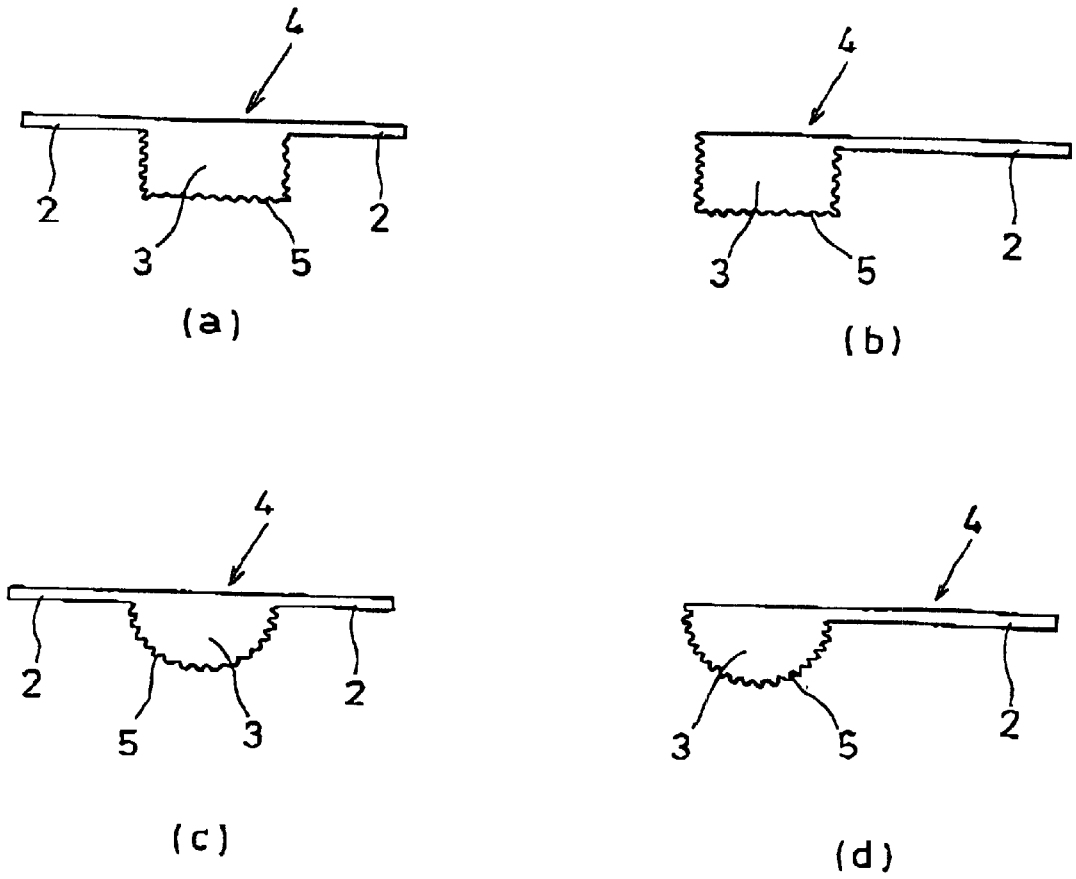
FIG. 4 shows top plan views illustrating further embodiments of joiner for vertical joint according to this invention.
Figure 5:
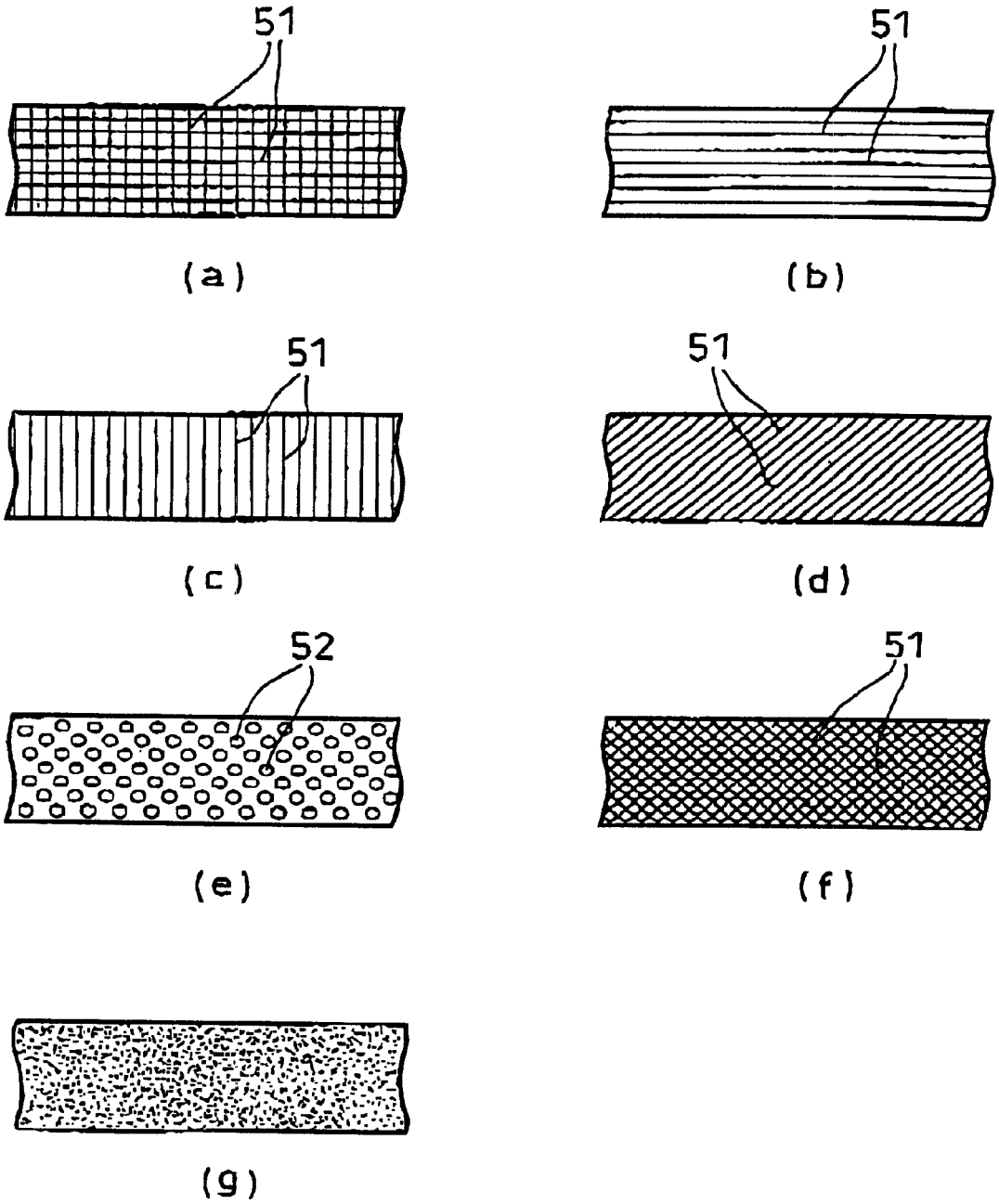
FIG. 5 shows top plan views schematically illustrating various examples of emboss pattern to be formed on the surface region of raised portion of the joiner for vertical joint, or on the surface of resin tape to be laminated on and adhered to the surface region of raised portion of the joiner.

FIGS. 3*e* through 3*g* illustrate other embodiments. In the embodiment shown in FIG. 3*e*, the cross-section of the main body portion 4 is H-Shaped, the raised portion 3 is formed as a front plate portion and the resin tape 6 is adhered to the entire surface of the front plate portion and to part of the rear surface of the front plate portion. In the embodiment shown in FIG. 3*f*, the cross-section of the main body portion 4 is L-shaped, the raised portion 3 is formed as a front plate portion and the resin tape 6 is adhered to the entire surface of the front plate portion, to part of the rear surface of the front plate portion and to the entire surface of the side portion. In the embodiment shown in FIG. 3*g*, the cross-section of the main body portion 4 is b-shaped and the resin tape 6 is adhered to the entire surface of the raised portion 3.

FIGS. 4*a* through 4*d* are top plan views illustrating four kinds of embodiment of the neon body portion 4 of the joiner, which were extruded products of polyethylene resin, propylene resin, or fluororesin, wherein emboss patterns 5 are formed by directly embossing the surface region of the raised portion 3.

FIGS. 5*a* through 5*g* are top plan views schematically illustrating other examples of emboss pattern to be formed on the surface region of raised portion 3 of the joiner 1 for vertical joint, or on the surface of resin tape 6 to be laminated on and adhered to the surface region of raised portion 3 of the joiner 1. In all of these examples excluding those shown in FIGS. 5*e* and 5*g*, the portions 51 indicated by the black solid line are projected portions or recessed portions, whereas the white portions are recessed portions or projected portions as opposed to the portions 51 indicated by the black solid line. In the example shown in FIG. 5*e*, the circled portions 52 are projected portions, whereas in the example show in FIG. 5*g*, the entire surface is formed into a satin-like pattern. In any of these examples, the ratio of the recessed portions is in the range of 10 to 90% per square centimeter.

According to the joiner for vertical joint of the present invention, since either the surface region of raised portion or the surface of resin tape to be laminated on and adhered to the surface region of raised portion, which are designed to be contacted with a sealing material, is formed into an embossed surface, the adhesive force between the sealing material and the surface region of raised portion of the joiner can be extremely minimized, and hence it is now possible to avoid the possibility that such a third adhesive surface that may restrict the elastic deformation of the sealing material fitted in the joint is formed between the sealing material and the surface region of raised portion of the joiner. As a result, it is now possible to almost completely prevent the sealing material filled in the vertical joint between the external wall members from being subsequently cracked or peeled away.

What is claimed is:

1. A joiner for forming vertical joints between neighboring external wall members, the joiner comprising:

a raised portion having a top surface region that forms a receiving area for a sealing compound and including a resin layer having an embossed surface, the embossed surface including a plurality of recessed portions, and the resin being selected from the group consisting of polyethylene, polypropylene, and fluororesin; and a first base portion directly connected on a right side of the raised portion and a second base portion directly connected on a left side of the raised portion, both the first and second base portions being in a common plane that is spaced from a plane defined by the top surface.

2. The joiner for the vertical joint according to claim 1, wherein said joiner for the vertical joint is formed from an extruded product of a resin selected from the group consisting of polyethylene, polypropylene and fluororesin.

3. The joiner for the vertical joint according to claim 1, wherein said resin layer is formed of a resin tape made of a resin selected from the group consisting of polyethylene, polypropylene and fluororesin, said resin tape being laminated on and adhered to the top surface of said raised portion.

4. The joiner for the vertical joint according to claim 1, wherein a ratio of recessed portions on said embossed surface of the resin layer is in the range of 10 to 90% per square centimeter, more preferably in the range of 20 to 80% per square centimeter.

5. The joiner for the vertical joint according to claim 4, wherein said joiner for the vertical joint is formed of an extruded product of resin selected from the group consisting of polyethylene, polypropylene and fluororesin.

6. The joiner for the vertical joint according to claim 4, wherein said resin layer is formed of a resin tape made of a resin selected from the group consisting of polyethylene, polypropylene and fluororesin, said resin tape being laminated on and adhered to the top surface of said raised portion.

7. A joiner for a vertical joint, the joiner being adapted to be positioned at the vertical joint formed between end faces of two neighboring external wall members, the joiner comprising:

a raised portion shaped to be fitted into a gap between the two neighboring external wall members, the raised portion including a top surface region that forms a receiving area for a sealing compound and includes a resin layer having an embossed surface, wherein a ratio of recessed portions on said embossed surface of the resin layer is in the range of 10 to 90% per square centimeter, and being formed of a resin selected from the group consisting of polyethylene, polypropylene, and fluororesin; and a first base portion on a right side of the raised portion and a second base portion on a left side of the raised portion, both the first and second base portions functioning as surfaces to be fixed to a framework of a building.

* * * * *